US006653934B2

(12) United States Patent
Pan et al.

(10) Patent No.: US 6,653,934 B2
(45) Date of Patent: Nov. 25, 2003

(54) ELECTRO-MAGNETIC AUDIO TRANSDUCER FOR SURFACE-MOUNTED DEVICES

(75) Inventors: Zhonglai Pan, Wujin (CN); Guoxin Jin, Shenzen (CN); Zhengmin Pan, Chino Hills, CA (US)

(73) Assignee: American Audio Components, Inc, La Verne, CA (US)

( * ) Notice: Subject to any disclaimer, the term of this patent is extended or adjusted under 35 U.S.C. 154(b) by 353 days.

(21) Appl. No.: 09/828,642

(22) Filed: Apr. 6, 2001

(65) Prior Publication Data

US 2002/0146143 A1 Oct. 10, 2002

(51) Int. Cl.[7] ..... G08B 3/10

(52) U.S. Cl. ..... 340/384.73; 340/388.1; 340/391.1; 340/396.1; 361/723; 310/89; 310/322; 381/396

(58) Field of Search ..... 340/384.73, 391.1, 340/388.1, 396.1; 361/723, 748, 752; 310/89, 322, 324, 332, 334; 336/192; 381/396, 409

(56) References Cited

U.S. PATENT DOCUMENTS

| | | | | |
|---|---|---|---|---|
| 5,287,084 A | | 2/1994 | Sone | 340/388.4 |
| 5,416,751 A | | 5/1995 | Imahori | 381/192 |
| RE36,828 E | | 8/2000 | Tajima | 310/89 |
| 6,389,148 B1 | * | 5/2002 | Yoo et al. | 381/417 |
| 6,529,115 B2 | * | 3/2003 | Szwarc et al. | 338/309 |

* cited by examiner

*Primary Examiner*—Donnie L. Crosland
(74) *Attorney, Agent, or Firm*—Birch, Stewart, Kolasch & Birch; Philip K. Yu

(57) ABSTRACT

An electromagnetic audio transducer for SMD applications. The transducer comprises a lead frame with external terminals, which are formed into a predetermined shape. The transducer has a case with inside and outside surfaces, where the case is integrated with the lead frame to expose the external terminals at its outside surface. The transducer has solder bases formed by exposing the lead frame at the inside surface of the case. The drive section of the transducer has a coil arranged inside the case, with the coil having coil terminals, and the coil terminals are led to the solder bases for electrical connection at the inside surface of the case.

12 Claims, 8 Drawing Sheets

ELECTRO-MAGNETIC AUDIO TRANSDUCER FOR SURFACE-MOUNTED DEVICES

FIELD OF THE INVENTION

The present invention relates to audio transducers based on electro-magnetic operation and more particularly to such transducers for use with surface-mounted devices ("SMD").

ART BACKGROUND

It is quite common to use audio transducers in electronic devices to convert an electrical signal input into sound by producing an acoustic output in response to the input signal. The application of such audio transducers, commonly known as buzzers, can be found in automobile dashboard electronics, appliances and portable electronic products. Particularly with portable devices, such audio transducers are required to be both reliable and compact. Such requirements are mostly likely demanded in the field of portable electronic devices, such as cell phones, PDA or pagers. A buzzer on the cell phone generates the ringing or the key stroke tone, in response to the respective electrical signals.

To be reliable, an ideal electromagnetic audio transducer should be able to withstand stringent and harsh tests such as thermal shock and drop test. By thermal shock, it is meant that the buzzer must not fail when temperature goes from one extreme to anther, such as when an user brings his or her cell phone from inside a car to an air conditioned room. Drop test means generally the device must maintain integrity and electrical contact after being dropped by the user.

To achieve compactness, the buzzer is made into a thin integrated chip, which must be able to fit tightly on the circuit board of the electronic device. This has led to the miniaturization of conventional buzzers using printed circuit boards ("PCB") and made way for SMDs. SMDs can be attached to the PCB of the electronic device without costing additional overall thickness.

Numerous thin buzzers for SMD applications have been disclosed in the art, as well in issued United States patents. One such patent issued to Tajima, U.S. Pat. No. Re. 36,828, disclosed an electronic transducer, where the device has a lead frame formed integrally with an outer case and a drive section within the outer case. The outer case has an opening (Tajima, FIG. 1, 3c) for passing the coil terminals, from the drive section, through to be connected to outer surface of the outer case, as shown in FIGS. 1 and 2 of the Tajima patent. The point of contact between the coil terminals and the part of the lead frame, known as the lands, is applied with solder to secure the contact.

Such approach has some disadvantages. One of them is that since the coil terminals are led out from inside the outer case through the opening, they necessarily become in contact with the opening. During thermal shock, i.e. reliability testing, the plastic material tends to expand such that the opening of the outer case ends up stretching the coil terminals, thus causing the soldered contacts to loosen.

Soldering the contact points as shown in the Tajima patent has another disadvantage. Although the opening and contact are formed in a groove section (Tajima, FIGS. 1 and 2, 3b) of the outer case, the overall thickness of the solder may exceed the clearance provided by the groove, thus forming an uneven surface for the outer case. As can be appreciated by anyone skilled in the art, an uneven plane on the outer surface of a SMD device is bound to create yield and defect problems. On the other hand, the amount of solder is limited by the headroom provided in the groove. In other words, too much solder affects the evenness of the surface, whereas too little solder causes poor connection between the lands and the coil terminals. Further, at the end of the process, the opening and the groove on the outer surface will need to be filled with glue, the application of which will contribute to the thickness and evenness on the outer surface.

Another disadvantage occurs when the lead frame is cut to form four terminals for external connections as illustrated in the Tajima patent in FIG. 5 (21, 23, 25, 27). When the frame is cut to construct the terminals, its tin content is exposed, which makes poor contact.

Therefore, it is desirable to have an audio transducer suitable for SMD connection.

It is also desirable to have an audio transducer with improved connection for the coil terminals.

It is further desirable to have an audio transducer with improved contact terminals from the lead frame.

SUMMARY OF THE PRESENT INVENTION

An electromagnetic audio transducer for SMD applications is disclosed. The transducer comprises a lead frame with external terminals, which are formed into a predetermined shape. The transducer has a case with inside and outside surfaces, where the case is integrated with the lead frame to expose the external terminals at its outside surface. The transducer has solder bases formed by exposing the lead frame at the inside surface of the case. The drive section of the transducer has a coil arranged inside the case, with the coil having coil terminals, and the coil terminals are led to the solder bases for electrical connection at the inside surface of the case.

A transducer constructed in accordance with the present invention will achieve a flatter outside surface for SMD mounting. No glue is needed to close any hole in the outer surface, thus preventing the glue from adding to the overall thickness of the device.

DETAILED DESCRIPTION OF THE PREFERRED EMBODIMENT

An electromagnetic audio transducer for SMD applications is disclosed. In the description that follows, various components, structures and method of manufacturing are described in general terms to facilitate the understanding of the invention, without obscuring the invention.

Figure 1:
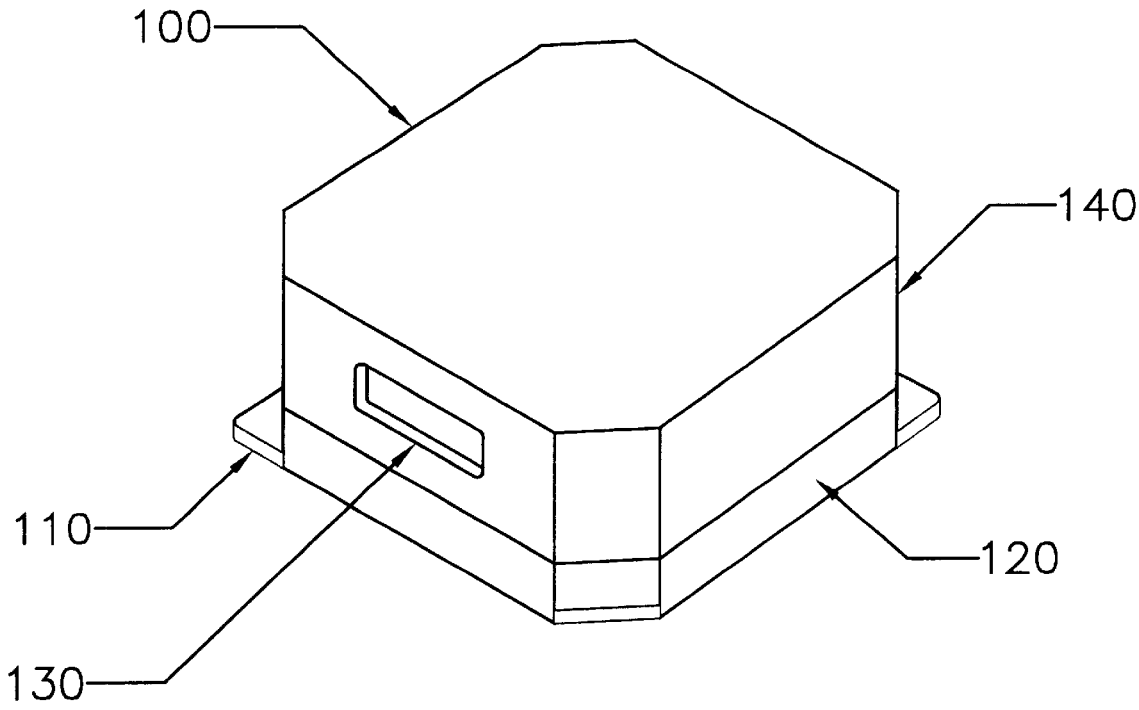
FIG. 1 shows an electromagnetic audio transducer in a finished form.

FIG. 1 shows an electromagnetic audio transducer in a finished form. Case 100 has upper housing 140 and lower housing 120. Sound port 130 is for transmission of sound made by the drive section (not shown) within the case 100. External terminals 110 are to make electrical connection with the SMD board.

Figure 2:
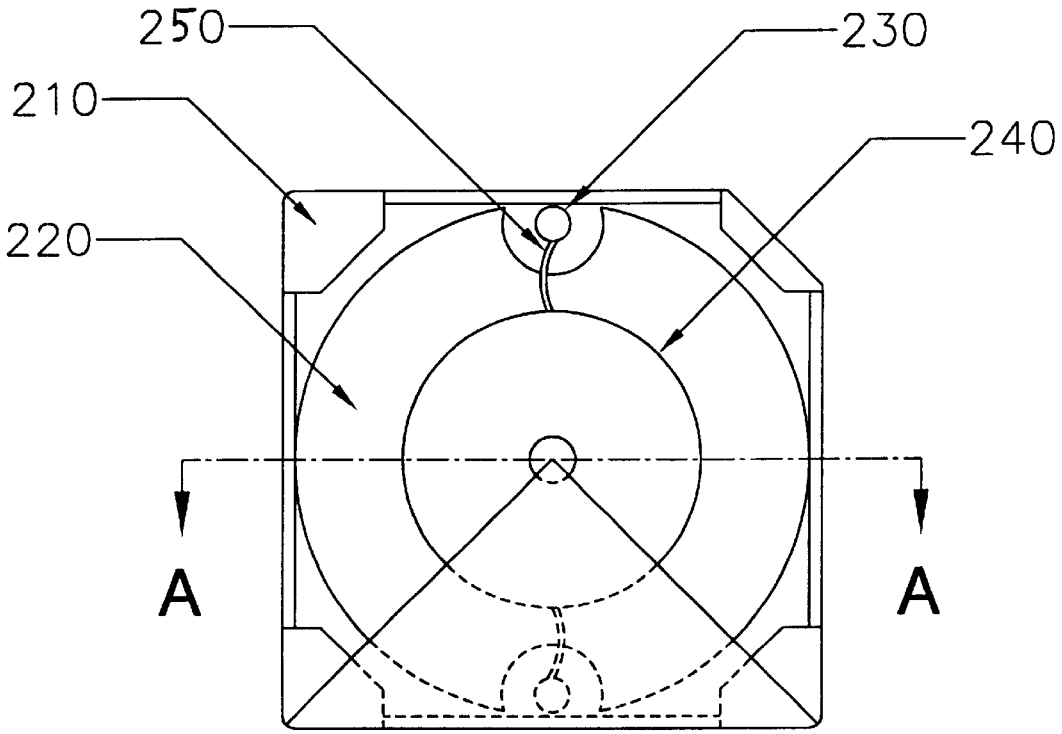
FIG. 2 shows a top view showing the drive section within the case 100, with a part of the upper housing 140 cut away, and showing a coil 240 and coil terminals 250.

FIG. 2 is a top view showing the drive section within the case 100, with a part of the upper housing 140 cut away, magnetic ring removed and showing coil 240 and coil terminals 250. The drive section has base 220 for supporting the coil 240 arranged on top of base 220. The coil terminals 250 are led from the coil 240 through the base 220 to solder base 230, which is part of a lead frame forming the external terminal 210. As such, the solder base 230 is electrically connected to the external terminal 210, of the same polarity. The base 220 can be shaped to provide a cut-off passage, or an opening, for the coil terminals 250 to reach the solder base 230. The solder base 230 is formed by exposing a portion of the lead frame when the lead frame is integrally formed with the lower portion of the case. The formation of the case with the lead frame will be further described in connection with FIGS. 5 and 6. A magnetic ring (not shown) is held above the base 220. Typically, the combination of the base 220, coil 240 and magnetic ring constitutes the drive section. Of course, there is a diaphragm and added mass on top of the drive section, which will respond to the changing of the magnetic flux, thus producing sound.

Figure 3:
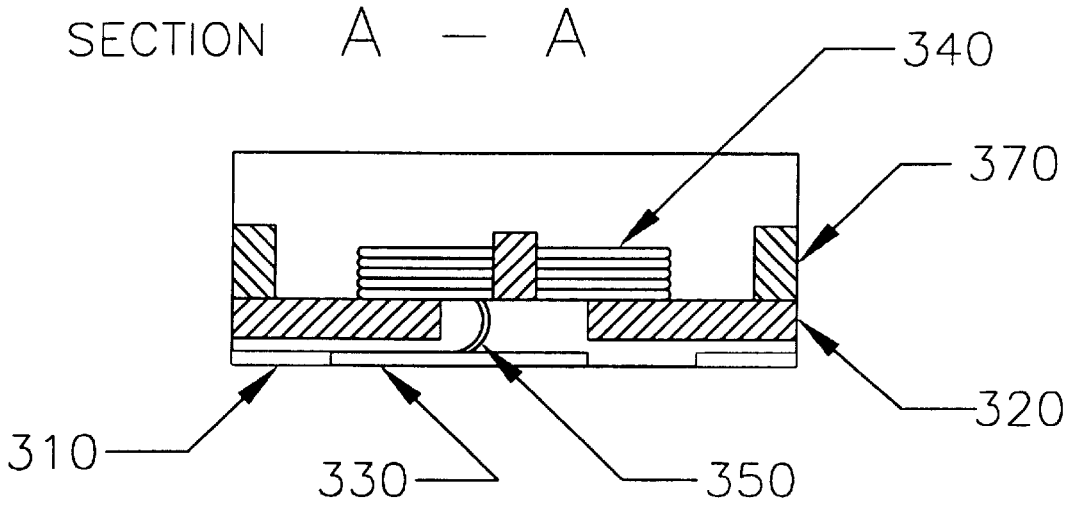
FIG. 3 shows a cross-sectional view of the first embodiment taken along the line A—A in FIG. 2.

FIG. 3 shows a cross-sectional view of the drive section of the first embodiment taken along the line A—A in FIG. 2. Coil 340 is placed on base 320 with coil terminal 350 being led to solder base 330 through an opening or cut-off passage on the base 320. The solder base 330 is electrically connected to electrical contact 310. Magnetic ring 370 sits on top of the base 320 around the inside wall of the case. The diaphragm and added mass on top of the drive section are not shown. However, those skilled in the art will recognize that such components, together with the drive section, produce sound as the coil terminals are energized.

It should be noted that since the coil terminal 350 is connected to the solder base 330 inside of the lower case, the overall thickness of the transducer device can be improved. In contrast to the Tajima device shown in U.S. Pat. No. Re. 36,828, no external groove is needed for the positioning of the coil or for the placement of glue after soldering. The space that is needed by the coil terminal of the present invention is already provided for by the thickness of the base 320, since the coil terminals are led through the body of the base 320. The groove in the Tajima device would have required at least a clearance of 0.3 mm for a typical SMD application. In the present invention, the thickness of the base 320 is typically 0.3 mm, plus any additional clearance, typically 0.35 mm, provided between the top of the solder base 330 and the bottom of the base 320. As a result, the soldering of the coil terminal to the solder base can be done in a clearance of 0.65 mm, thus making the connection of the present invention more secured, without the cost of increased thickness of the device.

Additionally, after the coil terminal 350 is attached to the solder base 330, adhesives may be applied to the point of contact at the solder base 330 to secure the attachment of the coil terminal 350. Nevertheless, the application of glue or adhesive to the coil terminal and the solder base inside of the housing does not nearly have the same impact to the overall thickness, or evenness of the external surface, as that of the glue applied to the external face of the device as is the case in conventional devices.

It should be pointed out that another thin buzzer manufacturer, Citizen, makes buzzers with coil terminals leading to the solder base inside the housing of the device. However, such connection is achieved through an opened section of the magnetic ring, which contributes to an imperfect magnetic flux pattern, as well as increased cost in manufacturing.

Figure 4:
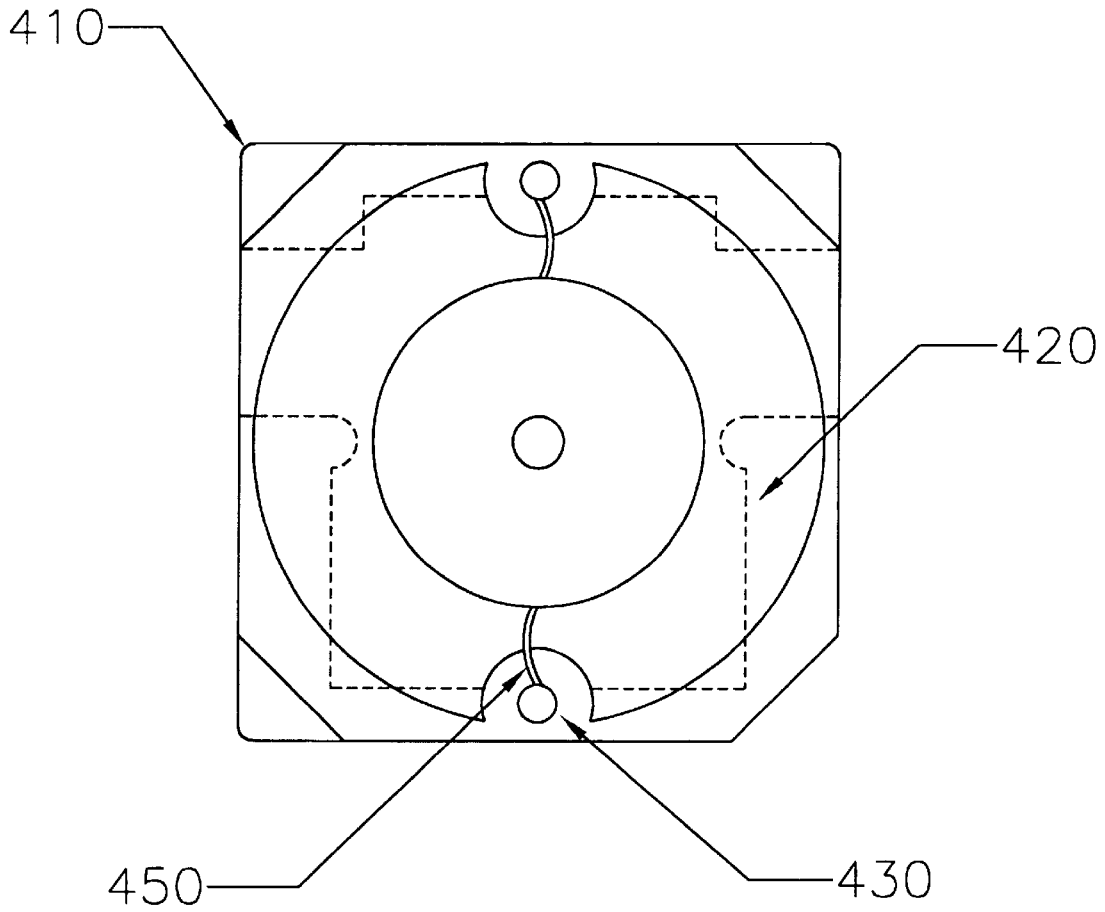
FIG. 4 shows a top view of the transducer with the upper case and the magnetic ring of the drive section removed

FIG. 4 shows a top view of the transducer with the upper case, magnetic ring of the drive section and diaphragm and mass removed. The lead frame underneath base 420 is shown in dashed line. As shown, solder base 430 is connected to only one electric contact 410; however it should be apparent to those skilled in the art that the lead frame may be formed to have the solder base connected to both contacts. The base 420 is shaped to leave a passage room, e.g. a hole or an opening, for coil terminal 450 to be attached to the solder base 430. Another shape of the base may be to leave one or two holes on the base 420 to provide passage for the coil terminals 450. As mentioned in connection with FIG. 3, a drop of glue, or adhesive, may be applied to the point of contact at the solder base 430 to secure the attachment of the coil terminal 450 to the solder base 430.

Figure 5:
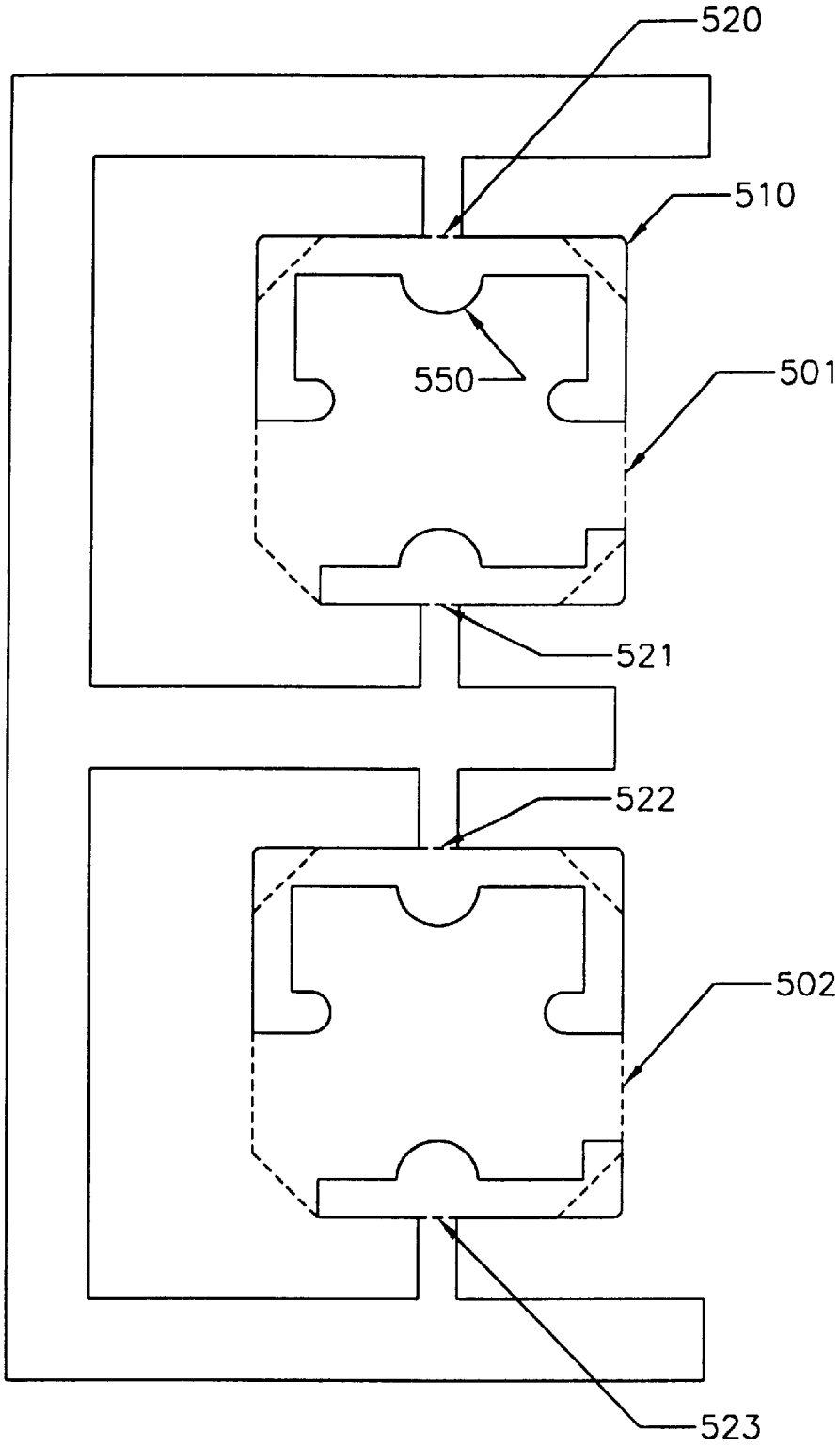
FIG. 5 shows the lead frame in one twin-pack shape.

FIG. 5 shows the lead frame in one shape. This lead frame has two frames 501 and 502 for supporting a twin pack of cases (shown by dashed line). It should be appreciated by those skilled in the art that such lead frame is only a section of a whole "ribbon" of lead frames, where many lower units of lower housing can be formed along the assembly line. The frames 501 and 502 are placed along a mold and resin is used to fill in the mold, thus producing the lead frame integrated with the lower housing of the case, while exposing the solder bases 550. After integration, the lead frame is cut at bridges 520, 521, 522 and 523. As previously described, cutting at the bridges 521, 521, 522, 523 leaves the contact comers 510 intact, without exposing its tin content. Compared to cutting the lead frame right at bridges where contacts are made by bending, this presents a superior methodology to ensure the continued integrity for electrical contact.

Figure 6:
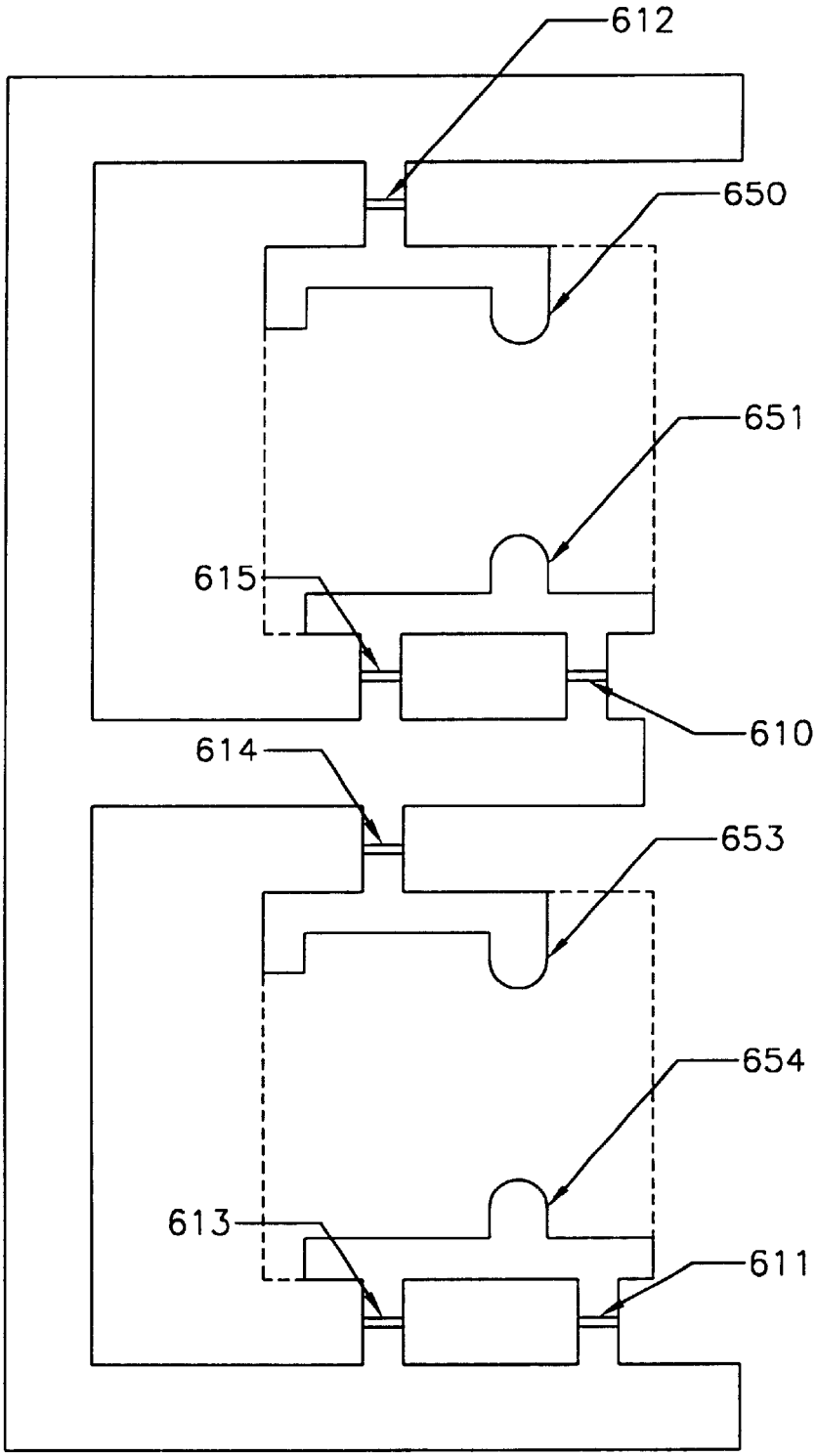
FIG. 6 shows the lead frame in another shape, supporting another twin-pack.

FIG. 6 shows the lead frame in another shape, where two frames can be used to support two units of lower housing for the cases (shown by dashed line). The lower housing of the transducer's case, after integrated with the lead frame, can be cut away by cutting at bridges 610, 611, 613, 614, 615. Those bridges can then be bent to form electrical contacts for the device. Note that solder bases 650, 651, 653 and 654 are formed by exposing them during the integration process.

Figure 7:
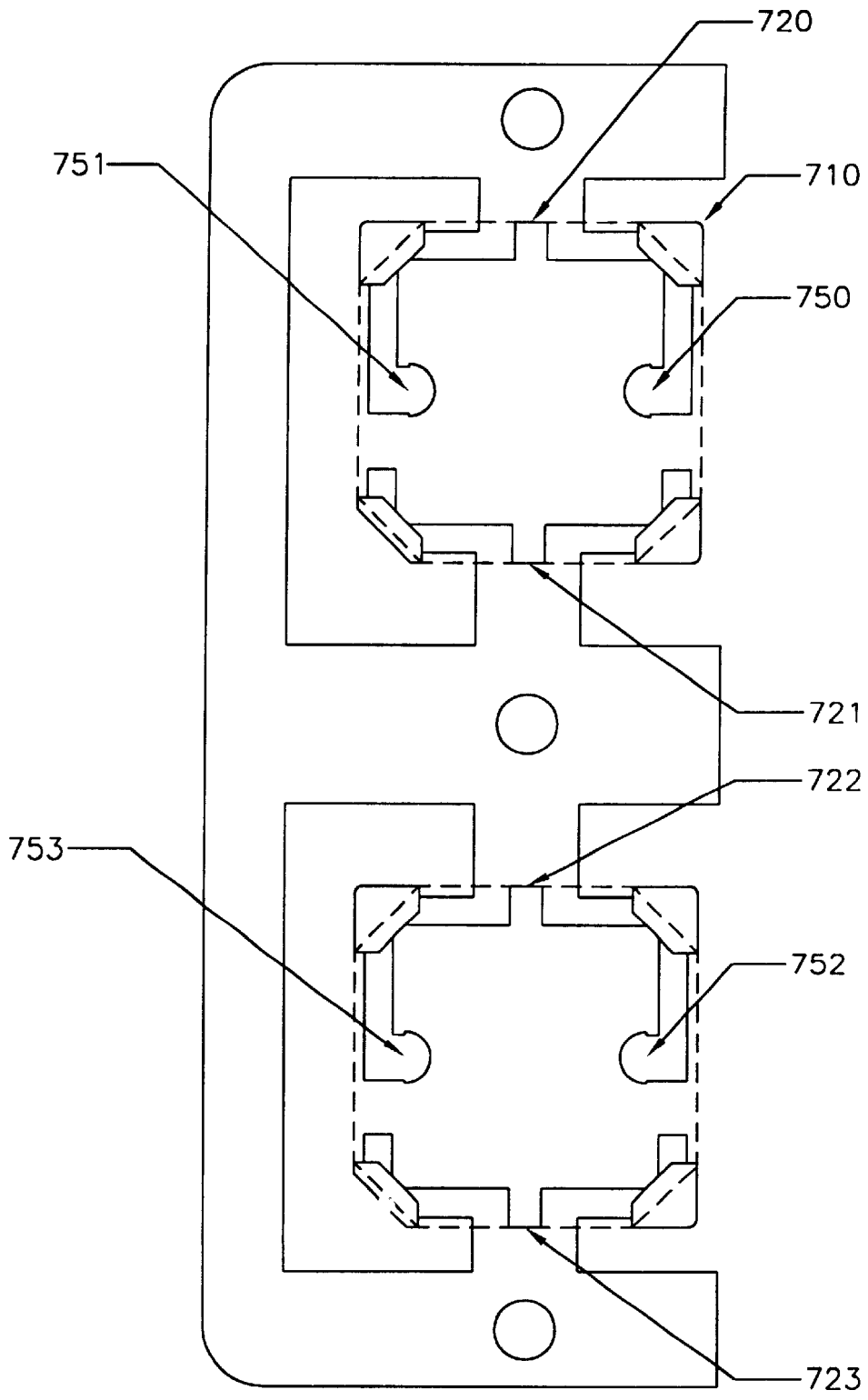
FIG. 7 shows the lead frame in another shape.

FIG. 7 shows the lead frame in yet another shape. This lead frame is also used to produce twin packs of devices. Bridges 720, 721, 722, 723 are cut, after the cases are integrated with the lead frame. Contacts, such as 710, are formed without having to be cut from the frame, thus ensuring integrity. Solder bases 750, 751, 752, 753 are formed on the same branch, before the bridges 720 and 722 are cut.

Figure 8:
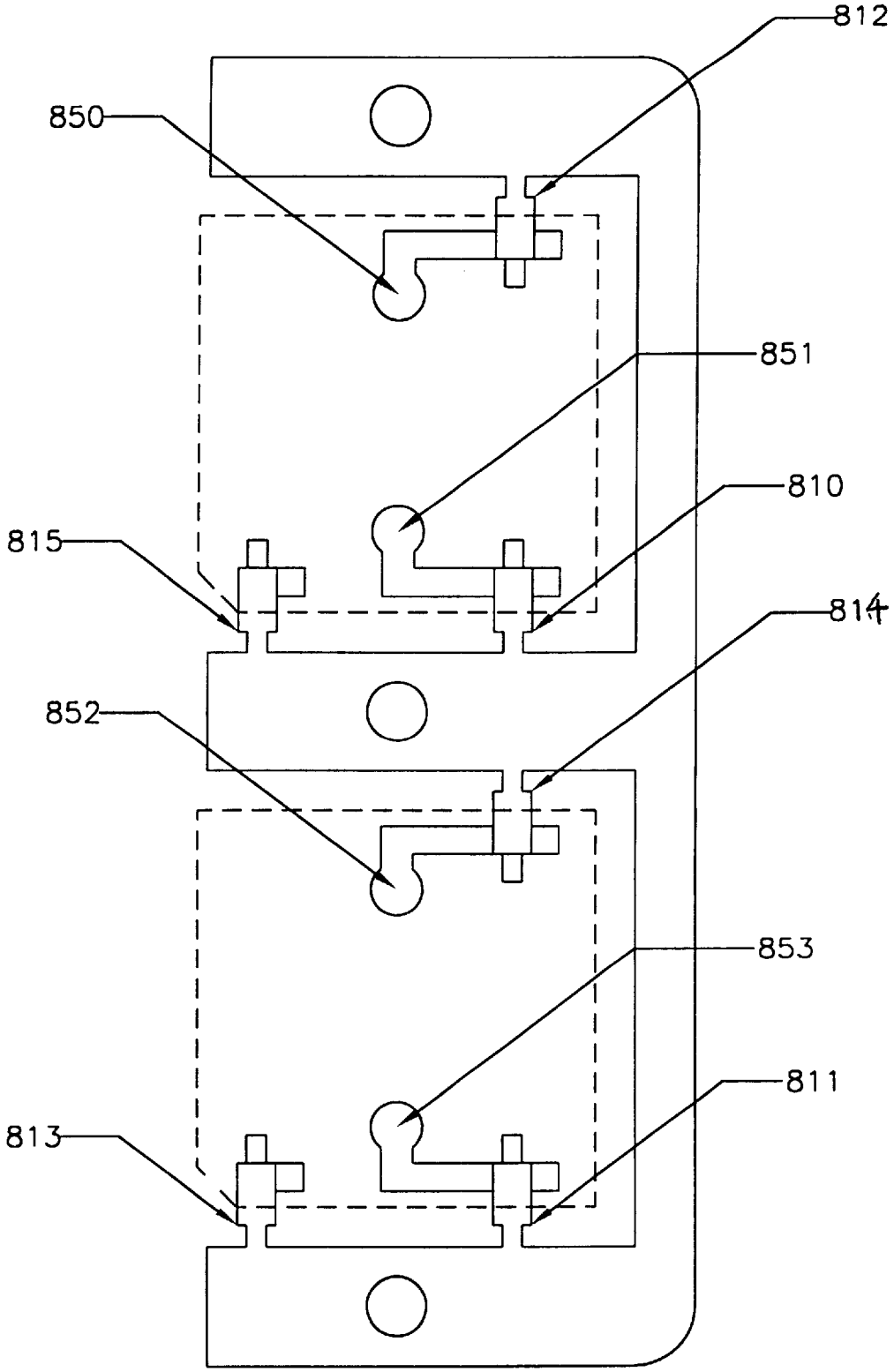
FIG. 8 shows the lead frame in yet another shape.

FIG. 8 shows the lead frame in yet another shape. Here, bridges 810, 811, 812, 813, 814, 815 are cut, after the cases are formed with the lead frame, to form contacts for the SMD. Solder bases 850, 851, 852, 853 are formed on different branches of the lead frame. As can be appreciated by those skilled in the art, numerous shapes of lead frames can be designed in accordance with the present invention.

The present invention may be embodied in other specific forms without departing from the spirit or essential characteristics thereof. The present embodiments are to be considered in all respects as illustrative, and not restrictive. The scope of the invention is therefore, indicated by the appended claims rather than by the foregoing description, and all changes which come within the meaning and range of equivalency of the claims are to be embraced within their scope.

We claim:

1. An electromagnetic audio transducer for SMD applications, comprising:

a lead frame with a plurality external terminals, formed into a predetermined shape;

a case with inside and outside surfaces, said case being integrated with said lead frame to expose said plurality of external terminals at its outside surface;

a plurality of solder bases formed by exposing said lead frame at said inside surface of said case;

a drive section with a coil arranged inside the case, said coil comprising a plurality of coil terminals, wherein said plurality of coil terminals are led to said plurality of solder bases to connect at said inside surface of said case.

2. The audio transducer of claim 1, wherein the drive section comprises a base between said coil and said insider surface of said case, said base comprising at least a partially opened passage for said coil terminals to be led to said solder bases.

3. The audio transducer of claim 1, where said lead frame comprises at least 2 branches, each branch at one end being connected to at least one external terminal and one of said plurality of solder bases, said branch at another end being adapted to be cut after integration of said lead frame with said case.

4. The audio transducer of claim 2, where said lead frame comprises at least 2 branches, each branch at one end being connected to at least one external terminal and one of said plurality of solder bases, said branch at another end being adapted to be cut after integration of said lead frame with said case.

5. An electromagnetic audio transducer for an SMD board, comprising:

an outer case;

a drive section including a coil arranged inside said outer case; and external terminals electrically connected to said drive section, wherein a plurality of solder bases are formed by exposing a portion of said external terminals on an inner surface of said outer case; and said coil has coil terminals connecting to said solder bases, through at least one opening on said drive section, on said inner surface of said outer case.

6. The audio transducer of claim 5, wherein said outer case has no opening formed therein for leading said coil terminals out of said outer case.

7. The audio transducer of claim 5, wherein said external terminals are integrated with said outer case.

8. The audio transducer of claim 5, wherein said external terminals comprise at least one separation bridge and a plurality of contacts, said contacts being adapted to make electrical connection to said SMD board, said separation bridge being adapted to be severed from a lead frame supporting said outer case after said external terminals are integrated with said outer case.

9. The audio transducer of claim 6, wherein said external terminals are integrated with said outer case.

10. The audio transducer of claim 6, wherein said external terminals comprise at least one separation bridge and a plurality of contacts, said contacts being adapted to make electrical connection to said SMD board, said separation bridge being adapted to be severed from a lead frame supporting said outer case when said external terminals are integrated with said outer case.

11. An electromagnetic audio transducer for SMD applications, comprising:

a lead frame with a plurality external terminals, formed into a predetermined shape;

a case with inside and outside surfaces, said case being integrated with said lead frame to expose said plurality of external terminals at its outside surface and to expose a plurality of solder bases at said inside surface of said case;

a drive section with a coil arranged inside the case, said coil comprising a plurality of coil terminals, wherein each of said coil terminals is led, through one at least partial opening on said drive section, to a corresponding solder base for electrical connection at said inside surface of said case, such that said outside surface of said case remains flat for SMD positioning.

12. The audio transducer of claim 11, wherein said drive section comprises a base with a post to hold said coil, said base having at least one passage for said coil terminals to lead through.

* * * * *